United States Patent [19]

Turbak et al.

[11] 4,374,702

[45] Feb. 22, 1983

[54] MICROFIBRILLATED CELLULOSE

[75] Inventors: Albin F. Turbak, Convent Station; Fred W. Snyder, Wharton, both of N.J.; Karen R. Sandberg, Shelton, Wash.

[73] Assignee: International Telephone and Telegraph Corporation, New York, N.Y.

[21] Appl. No.: 313,726

[22] Filed: Oct. 22, 1981

Related U.S. Application Data

[63] Continuation of Ser. No. 107,446, Dec. 26, 1979, abandoned.

[51] Int. Cl.[3] ..... D21D 1/20

[52] U.S. Cl. ..... 162/100; 162/9; 162/187; 241/5; 241/28; 241/40

[58] Field of Search ..... 162/9, 21, 1, 176, 187, 162/100; 241/5, 40, 28

[56] References Cited

U.S. PATENT DOCUMENTS 3,701,484 10/1972 Donovan ..... 241/5

FOREIGN PATENT DOCUMENTS 949464 2/1964 United Kingdom ..... 162/187

1300820 12/1972 United Kingdom .

*Primary Examiner*—Peter Chin

*Attorney, Agent, or Firm*—James B. Raden; Harold J. Holt

[57] ABSTRACT

Microfibrillated celluloses having properties distinguishable from all previously known celluloses, are produced by passing a liquid suspension of cellulose through a small diameter orifice in which the suspension is subjected to a pressure drop of at least 3000 psig and a high velocity shearing action followed by a high velocity decelerating impact, and repeating the passage of said suspension through the orifice until the cellulose suspension becomes a substantially stable suspension. The process converts the cellulose into microfibrillated cellulose without substantial chemical change of the cellulose starting material.

11 Claims, 5 Drawing Figures

RATE OF DEGRADATION INCREASE

MICROFIBRILLATED CELLULOSE

Figure 1:
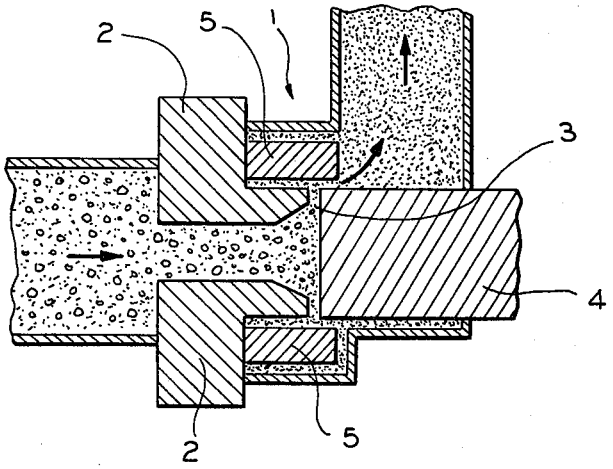

This is a continuation of application Ser. No. 107,446 filed Dec. 26, 1979 now abandoned.

This invention relates to microfibrillated cellulose and to a process for its preparation.

Processes for opening or beating of pulp fibers to obtain fibrillation, increased surface area, increased accessibility and fine particle size have long been known. Ball mills of various types are used for preparing cellulose of several tens of microns in dimension. Studies have indicated that such ball milling breaks the chemical bonds of the cellulose during the sub-dividing process. It is also known to grind cellulose in water under pressure to produce a microcellulose with a particle size of less than one micron. In the case of cellulose derivatives, cold milling of the derivatives in liquid nitrogen is also disclosed in the prior art. Sonic pulverization with a ball mill is also a known method of producing cellulose in extremely fine particle size. Such finely divided celluloses have been used as low calorie additives to foods and as thickeners in pharmaceutical products. They are also widely used as thickeners, extenders and carriers in the cosmetic and toiletry industry.

Finely divided celluloses are also produced in the traditional processes used in manufacturing mechanical pulps, fiberboard and paper pulp. Normally, however, these traditional processes involve the use of additional chemical treatment to available cellulose pulps, as for example, acid hydrolysis or mercerization, which chemically alter or degrade the prepared cellulose pulps.

In the paper industry, it is well known that paper strengths are directly related to the amount of beating or refining which the fibers receive prior to formation. However, beating and refining as practiced in the paper industry are relatively inefficient processes since large amounts of energy are expended to gain relatively minor amounts of fiber opening and fibrillation.

Special forms of cellulose, such as the microcrystalline celluloses, are also known. In microcrystalline cellulose, the amorphous, accessible regions of the cellulose are either degraded or dissolved away leaving the less accessible crystalline regions as fine crystals a few tens of microns in size. In preparing microcrystalline cellulose, it is necessary to destroy a significant part of the cellulose to produce the final product, and consequently, is is quite expensive. In addition, most of the desirable amorphous reactive part of the fiber is removed and destroyed leaving only the microcrystals which are primarily surface reactive.

It is a principal object of the present invention to produce a new type of cellulose having properties and characteristics distinguishing it from all previously known celluloses.

It is a further object of the present invention to produce a finely divided cellulosic material which has vastly increased surface area, greatly improved absorption characteristics and vastly improved reactivity and binding capability.

It is an additional object of the present invention to produce a microfibrillated cellulose without substantial chemical change or degradation of the cellulose starting material.

It is still an additional object of this invention to provide a process for producing a very finely divided cellulosic material having a number of unusual properties and uses.

The foregoing and other objects of this invention are achieved by passing a liquid suspension of fibrous cellulose through a small diameter orifice in which the suspension is subjected to a pressure drop of at least 3000 psi and a high velocity shearing action followed by a high velocity decelerating impact and repeating the passage of said suspension through the orifice until the cellulose suspension becomes a substantially stable suspension. The process converts the cellulose into microfibrillated cellulose without substantial chemical change.

The microfibrillated cellulose of the invention has a water retention value of over 280%, a settling volume after 60 minutes in a 0.5% by weight suspension in water of greater than 60% and a rate of degradation increase by hydrolysis at 60° C. in one molar hydrochloric acid at least twice as great as cellulose beaten to a Canadian Standard Freeness value of 50.

Figure 2:
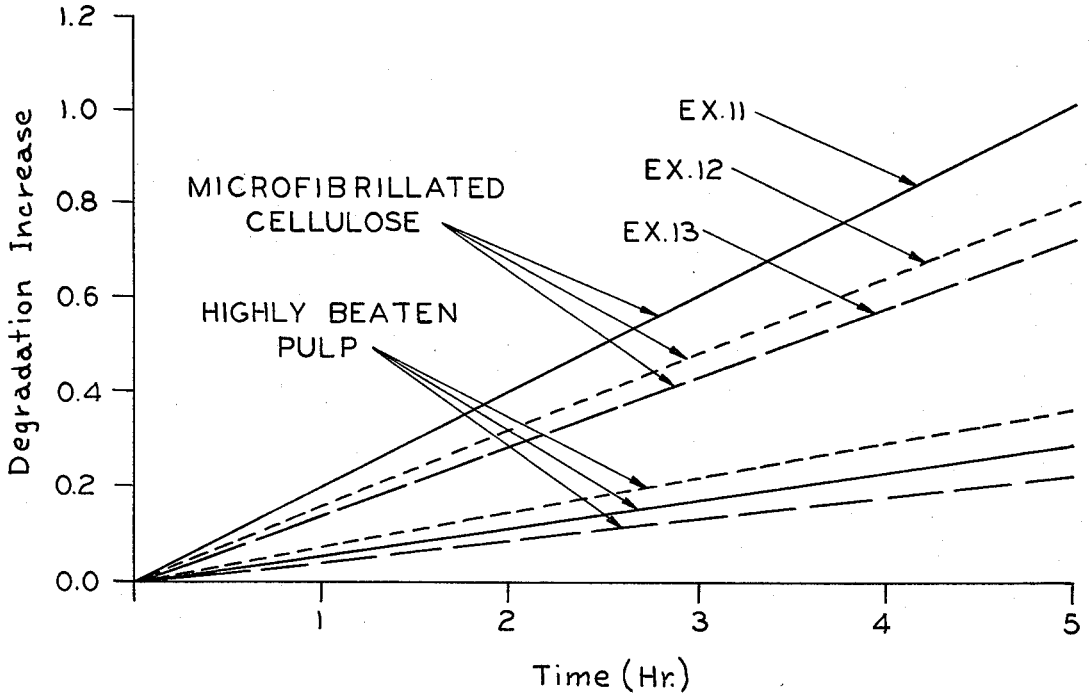

The invention will be better understood by reference to the accompanying drawing in which FIG. 1 is a schematic cross-sectional diagram of an apparatus suitable for carrying out the present invention; and FIG. 2 is a graph showing the rate of degradation increase for acid hydrolysis of microfibrillated cellulose samples of the invention as compared with the corresponding rate for highly beaten pulp.

Figure 3:
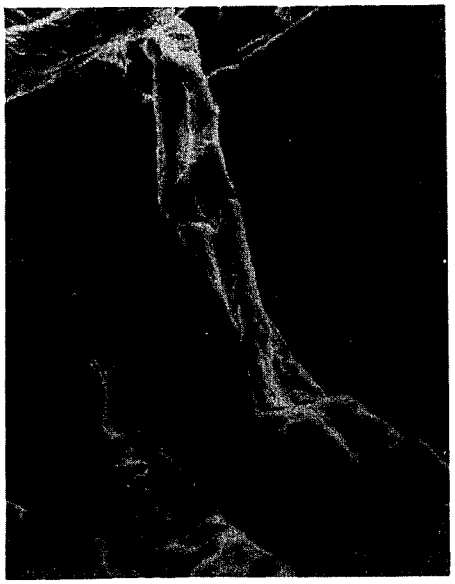
Figure 4:
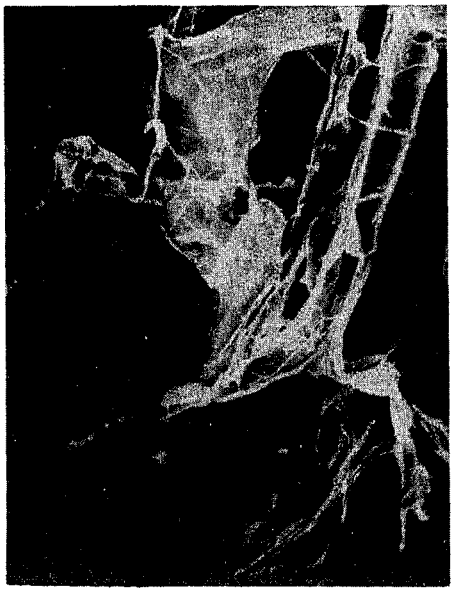
Figure 5:
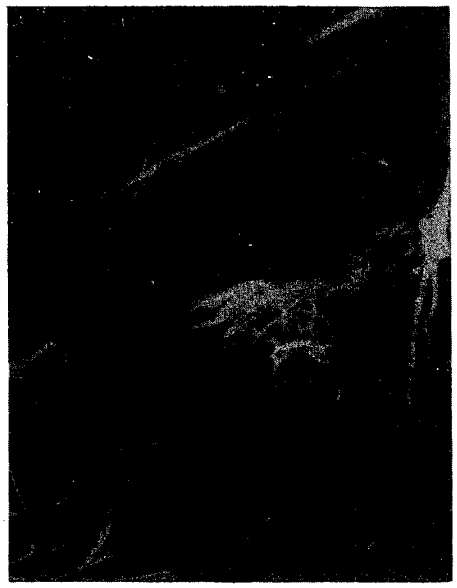

FIGS. 3, 4, & 5 are photomicrographs of untreated pulp fibers (FIG. 3) and of microfibrillated fibers after 5 passes (FIG. 4) and 20 passes (FIG. 5).

A particularly suitable device for carrying out the invention is a high pressure homogenizer of a type which is commercially available and used to produce emulsions and dispersions. In such a device, energy is applied to a low viscosity suspension by a high velocity flow through a restricted area. The heart of such a device is a homogenizer valve and valve-seat assembly which is attached to the discharge end of a high pressure pump. A typical valve assembly is shown in FIG. 1 of the drawing. As shown by the arrow, a liquid suspension enters the valve assembly, the valve assembly being generally identified by the numeral 1, within the valve seat 2. At this point the liquid is at high pressure and low velocity. As the liquid advances to the small diameter orifice 3 formed in the close clearance area between the valve 4 and valve seat 2, there is a very rapid increase in velocity up to as high as 700 ft/second, depending on the operating pressure. The pressure drop is measured from the entrance to the exit side of orifice 3. As the suspension emerges from between the valve and the valve seat, it impinges on an impact ring 5 surrounding the orifice and this results in a high velocity decelerating impact. Orifice 3 must be small enough to create the required shearing action but must be larger than the fiber diameter. This will normally translate into a diameter of about 1/64" to ¼". Such homogenizers and their operation are described at various places in the literature, as for example in an article entitled "Evaluating Homogenizers for Chemical Processing" by L. H. Rees which appeared in Chemical Engineering, May 13, 1974, pages 86–92. Reference should be made to the foregoing literature for a more complete description of such devices.

The microfibrillated product of the invention is compared with untreated pulp in the actual scanning electron photomicrographs of FIGS. 3, 4 and 5, all at a magnification of 500 times. The pulp in each case was a sulfite pulp from hemlock wood. In FIG. 3, the untreated pulp fibers are substantially smooth and of a flattened cylindrical shape, with kinks or bends. In FIG. 4, the fibers, after five passes through the homogenizer, have been torn apart into their component layers and fibrils. In FIG. 5, after twenty passes through the homogenizer, fiber character is no longer apparent. Lamellar sheets have been explosively dissected into fibrils.

The microfibrillated cellulosic product of the invention possesses a number of characteristics which render it uniquely different from other known cellulosic products. It is not chemically degraded by the process and its degree of polymerization remains substantially unchanged. On the other hand, it has a higher degree of fibrillation and greater accessibility than any previously known cellulosic product. In addition, in both aqueous and organic solvents, the microfibrillated cellulose achieves a "gel-point" after repeated passage through the fibrillating process. The gel-point is characterized by a critical point in the process at which the cellulosic suspension rapidly thickens to a more viscous consistency. The suspension is thereafter substantially stable even after prolonged storage. By substantially stable suspension is meant a suspension in water which upon dilution to 0.5% and upon standing for one hour, maintains at least 60% of its original volume, i.e. contains no more than 40% of clear liquid. Normally, the present suspensions will maintain at least 80% of their original volume. Such stable suspension or gel-points are well known for starch, but insofar as known, have never previously been observed for cellulose. The microfibrillated cellulose of the invention also has a significantly greater ability to retain water than the most closely related cellulosic products of the prior art. Water retention is above 280% by weight of cellulose, usually above 300% and in many instances ranges considerably higher. Degradation increase by acid hydrolysis, a recognized measure of accessibility for cellulose are at least twice as great as highly beaten cellulosic pulp. Comparisons herein between the properties of the present celluloses and prior art cellulose are comparisons with celluloses of the same origin, i.e. celluloses prepared by substantially similar pulping techniques. These foregoing and other characteristics of the product make it uniquely suitable for a wide variety of applications, some of which are new, including use with paper products and non-woven sheets to improve their strength.

In carrying out the invention, cellulosic pulp or other unregenerated fibrous cellulose is added to a liquid to produce a cellulosic suspension. A particularly suitable source of cellulose is regular, fiber-length pulp, derived from either hardwood or soft-wood, normally available from a pulping operation or pre-cut if desired. The pulp may be from any of the well known digestion techniques including both chemical and mechanical pulping. Virtually any liquid may be used provided it is chemically inert in the process and imparts sufficient fluidity to act as a carrier for the cellulose. In addition to water, such organic liquids as dimethylsulfoxide, glycerine and lower alcohols may be used. The proportion of cellulose in the suspension may vary depending, among other factors, on the size of the homogenizer or other equipment in which the cellulose is microfibrillated. Larger size or commercial scale homogenizers may use suspensions containing larger proportions of cellulose. Smaller particle size or shorter fiber length starting cellulose also permits use of larger concentrations of cellulose. Normally, the suspension will contain less than about 10% cellulose by weight and preferably the amount of cellulose will range from 4–7% by weight in commercial scale operation.

The foregoing liquid suspension or slurry is introduced in the homogenizer and brought to a pressure of at least 3000 lbs/sq in. (20,670 kilopascals), preferably 5-8000 psi (34,450 kPa–55,120 kPa). The slurry is then repeatedly passed through the homogenizer until the slurry forms a substantially stable cellulosic suspension. The temperature of the slurry rises as the slurry is passed through the homogenizer. It is believed that an interaction of both high pressure drop and elevated temperature is necessary to produce the microfibrillated cellulose of the invention. To minimize the number of passes through the homogenizer, the cellulosic slurry should be initially heated to a temperature of at least 50° C., even more preferably at least 80° C., prior to the initial introduction of the slurry into the homogenizer. At pressures of less than about 3000 lbs/sq in., no amount of heating or processing will produce a stable suspension.

The following examples are illustrative of the practice of the invention. Unless otherwise indicated, all parts and percentages are by weight.

EXAMPLE 1

A 2% cellulose slurry in approximately 3 gallons of water was prepared using prehydrolyzed kraft pulp which has been cut to pass through a 0.125 inch screen. The slurry was divided into four portions, each of which was processed separately. The starting temperatures of the slurries were 25° C. (room temperature), 60° C., 75° C. and 85° C. The slurries were passed through a Manton-Gaulin (trademark) homogenizer at 8000 lbs/sq. in. (gauge) two or more consecutive times until a stable suspension or gel-point was reached.

The room temperature slurry required 11 passes through the homogenizer to produce a stable suspension. At the end of seven passes, the temperature had risen to 70° C. and at the end of the eleventh pass, the temperature was 95° C. The slurry whose initial temperature was 85° C. arrived at the desired endpoint after 2 passes and the final temperature was 96° C.

These experiments indicate that for commercial production of microfibrillated cellulose, it is more economical to preheat the system than to utilize repeated passes through the homogenizer.

EXAMPLE 2

The entire set of experiments set forth in Example 1 was repeated except that 20% of glycerine, based on total weight of the slurry, was added to the slurry to determine the effect of a plasticizer on the process. The glycerine did not lower the gel-point formation conditions significantly. That is, it was found the gelling behavior again occurred with essentially the same number of passes through the homogenizer at the same initial pressures and temperatures.

EXAMPLE 3

All of the experiments of Example 1 were again repeated substituting however an organic carrier, dimethylsulfoxide, for water. No significant change in behavior was noted, gelling occurred at the same number of passes at the same initial pressures and temperatures.

EXAMPLE 4

A series of experiments was run to compare the water retention characteristics of microfibrillated cellulose produced in accordance with the invention with microcrystalline cellulose and with highly beaten pulp. The microcrystalline cellulose used was a commercially available grade sold under the trademark Avicel PH-105. The beaten pulp was pulp which had been beaten in a standard PFI mill to various degrees of freeness. (A PFI mill is a machine developed by Papirindustriens Forsknings Institute-The Norwegian Pulp and Paper Research Institute. It is known throughout the world as a PFI mill). Table I records the water retention values of a series of tests of the foregoing celluloses. The water retention of a cellulose material is a measure of its capacity to retain water when subjected to centrifugal force under conditions selected to remove most of the surface water. Accordingly, the measurement is primarily that of the water held within the fiber and reflects the degree of fiber swelling in water. The water retention values in Table I represent the percentage by weight of water based on the weight of the original cellulose. For comparison, Table I also records the water retention values of the starting prehydrolyzed kraft pulp used to prepare both the microfibrillated pulp and the beaten pulp. The microfibrillated pulps were prepared at pressures of 8000 psi. The CSF (Canadian Standard Freeness) numbers are a measure (in ml) of how fast the fibers allow water to drain from a slurry through a screen. The measurement is in accordance with TAPPI Bulletin T227 M-58, dated May 1943, revised August 1958. A CSF number of 182 is a very highly beaten pulp; a CSF number of 749 is essentially an unbeaten pulp.

The water retention tests were conducted by allowing the sample of the aqueous cellulosic suspension to drain in a cup with a perforated bottom, centrifuging at 3600 rpm (to give 1000 gravities on the sample) for ten minutes and removing and weighing the cellulosic sample. The sample was then dried in an oven at 105° C. for a minimum of four hours and reweighed. Water retention values were determined by subtracting the oven dried weight of the sample from the wet weight after centrifuging, dividing by the oven dried weight and multiplying by 100.

TABLE I

| Sample No. | Cellulose | Water Retention Value (%) |
|---|---|---|
| 1 | Untreated Pulp | 57 |
| 2 | Microcrystalline Cellulose | 112 |
| | Beaten Pulp | |
| 3 | CSF 749 | 57 |
| 4 | CSF 500 | 77 |
| 5 | CSF 385 | 84 |
| 6 | CSF 182 | 104 |
| | Microfibrillated Pulp | |
| 7 | Unheated - 8 passes | 331 |
| 8 | Preheated to 75° C.-4 passes | 385 |

EXAMPLE 5

An important distinguishing characteristic of the finely divided cellulosic product of the invention is its ability to form a substantially stable suspension. A series of tests was conducted to determine the settling rate of aqueous suspensions of microfibrillated cellulose. The microfibrillated cellulose was prepared from prehydrolyzed kraft pulp cut to a screen size of 0.125 inch. A 2% aqueous slurry of the pulp was passed both at initial room temperature and preheated through a homogenizer as in Example 1 at 8000 psig for from one to eight passes. The suspension of microfibrillated cellulose was then diluted to produce a 0.5% dispersion of microfibrillated cellulose in water. The stability of the suspensions was determined by measuring the settled volume as a percentage of original volume after one hour of standing at ambient temperature. The untreated cellulosic pulp, prior to passing through the homogenizer, settled essentially immediately, i.e. did not form an aqueous suspension. The remaining results are set forth in Table II.

TABLE II

| Sample | No. of Passes Through Homogenizer | Final Slurry Temperature °C. | Settled Volume % |
|---|---|---|---|
| 1 | 1 | 50 | 10 (after only ten minutes) |
| 2 | 1 (preheated to 75° C.) | 86 | 38 |
| 3 | 3 | 68 | 42 |
| 4 | 5 | 77 | 98 |
| 5 | 8 | 100 | 100 |
| 6 | 4 (preheated to 75° C.) | 100 | 100 |

Sample 1 was essentially only slightly fibrillated since it reached a settled volume of 10% after only ten minutes standing. Samples 2 and 3 were insufficiently fibrillated as they reached a settled volume of 42% or less after one hour.

EXAMPLE 6

In order to compare responses of pulps produced by different pulping processes, samples of sulfite pulps, kraft (sulfate) pulps and prehydrolyzed kraft pulps were compared with respect to water retention values after comparable preparation. All samples were prepared by passing from one to eight times through the homogenizer at initial pressures of 8000 psig and ambient temperatures. Results are set forth in Table III.

TABLE III

| Sample No. | Type of Pulp | No. of Passes | Water Retention |
|---|---|---|---|
| 1 | Sulfite | 0 | 60 |
| 2 | Sulfite | 5 | 340 |
| 3 | Sulfite | 8 | 397 |
| 4 | Kraft | 0 | 100 |
| 5 | Kraft | 5 | 395 |
| 6 | Prehydrolyzed Kraft | 0 | 60 |
| 7 | Prehydrolyzed Kraft | 5 | 310 |
| 8 | Prehydrolyzed Kraft | 8 | 330 |

While differences do exist, all three pulps appear from Table III to exhibit marked increases of comparable magnitude in water retention values after from five to eight passes through the homogenizer.

EXAMPLE 7

In order to compare the water retention values of microfibrillated cellulose with those of pulps beaten to various degrees of freeness by a standard paper beater, a series of tests was conducted. A variety of pulps was beaten in a standard PFI disc refiner to various degrees of CS Freeness (defined above in Example 4) until the maximum possible amount of beating was reached. Their water retention values were measured at the various Freeness levels. The results are set forth in Table IV.

TABLE IV

| Sample No. | Type of Pulp | CS Freeness | Water Retention (%) |
|---|---|---|---|
| 1 | Sulfite | 625 | 170 |
| 2 | Sulfite | 470 | 210 |
| 3 | Sulfite | 235 | 220 |
| 4 | Sulfite | 50 | 265 |
| 5 | Kraft | 580 | 165 |
| 6 | Kraft | 380 | 185 |
| 7 | Kraft | 215 | 190 |
| 8 | Kraft | 50 | 195 |
| 9 | Prehydrolyzed Kraft | 540 | 165 |
| 10 | Prehydrolyzed Kraft | 315 | 195 |
| 11 | Prehydrolyzed Kraft | 100 | 220 |
| 12 | Prehydrolyzed Kraft | 50 | 245 |

Table IV illustrates that known methods of beating pulp, even if taken to abnormal and extreme levels, do not give products similar to microfibrillated cellulose. Moreover, the severely beaten pulps differ from the present microfibrillated cellulose in another important respect, their chemical reactivity, as brought out in the following example.

EXAMPLE 8

A valuable measure of the accessibility of cellulose is that known as the "cuene residue" test. Cuene, or cupriethylenediamine, at 1 molar concentration, dissolves all celluloses, whether it be cotton or unbeaten pulp, without any residue. As the cuene concentration is decreased, there is an increasing proportion of residue remaining, depending on relative isolubility. Dilute cuene tests were made on beaten pulps of various degrees of freeness (beaten in a PFI mill as in example 7 to corresponding degrees of freeness) and on microfibrillated cellulose. All of the pulps tested were prehydrolyzed kraft pulp. The microfibrillated cellulose was passed through the homogenizer at initial pressures of 8000 psig. Table V sets forth the percentage of residue for the various pulps when subjected to the diluted cuene tests at 25° C. at the cuene concentrations shown.

TABLE V

| Cuene Concentration (g/ml) | % Residue: Beaten Pulp CS Freeness 535 | 309 | 89 | 60 | Microfibrillated Pulp No. Of Passes 1 | 5 | 8 |
|---|---|---|---|---|---|---|---|
| 12 | 98.2 | 98.2 | 95.5 | 88.2 | 79.1 | 69.1 | |
| 14 | 92.7 | 86.3 | 79.1 | 77.3 | 68.2 | 41.8 | 30.0 |
| 16 | | | | | 33.6 | 19.1 | 11.8 |
| 17 | | | | | 9.1 | 7.2 | 5.4 |

It will be apparent from the above table that the beaten pulps have significantly more residue and are far less dissolved as compared to the microfibrillated cellulose. These data demonstrate that a major change in accessibility occurs if the pulp is homogenized in accordance with the invention. Optical photomicrographs of the various pulp samples of this example showed an unmistakably more open structure for the homogenized pulps as compared to the most severely beaten pulps.

The microfibrillated cellulose of the invention emerges from the homogenizer as a substantially stable suspension. The foregoing examples have dealt with the preparation and testing of such microfibrillated cellulose suspensions. It has been found that drying of the microfibrillated cellulose modifies its properties and is moreover relatively costly. It is accordingly preferred that the microfibrillated cellulose be used in undried form, as an aqueous or organic suspension. However, it may be desirable in certain instances to use dried microfibrillated cellulose. The following example illustrates the preparation of microfibrillated cellulose and the subsequent drying and testing of the product so produced.

EXAMPLE 9

Moist sulfite pulp (370 grams wet=100 grams oven dried weight), which had not been dried subsequent to pulping, was dispersed in 10 liters of deionized water using a counter-rotating mixer. The slurry was passed through a homogenizer at 8000 psig and less than 40° C. for five, ten and twenty passes. The resulting slurries were freeze-dried. The reactivity of the microfibrillated cellulose was determined by measuring the dilute cuene solubility and comparing the results with that of the starting pulp and of the starting pulp cut to a screen size of 0.125 inch. The cuene solubility tests were carried out with 0.125 N Cuene at 25° C. with a constant temperature shaker bath. The following table sets forth the percentage of residue of the microfibrillated cellulose and of the control samples when subjected to the dilute cuene tests.

TABLE VI

| Sample No. | Description of Cellulose | % Cellulose Residue |
|---|---|---|
| 1 | Untreated Pulp | 71.0 |
| 2 | Untreated Pulp (cut to 0.125 Screen Size) | 52.4 |
| 3 | Microfibrillated - five passes | 33.1 |
| 4 | Microfibrillated - ten passes | 14.9 |
| 5 | Microfibrillated - twenty passes | 5.7 |

The "Intrinsic Viscosity" (I.V.) of a long-chain compound such as cellulose describes a viscosity function which is proportional to the average degree of polymerization (D.P.) of the long-chain compound. The I.V. of cellulose in cupriethylenediamine solution is known as the cuene I.V. It is obtained from a measurement of the fractional increase in viscosity of the solvent, due to dissolved cellulose (i.e. the specific viscosity), at a 0.5% concentration of the solute by extrapolating the viscosity-concentration function to zero concentration. The following example compares the cuene I.V. of a series of pulp samples both before and after homogenization.

EXAMPLE 10

A 1% total solids slurry in water of sulfite pulp, which had not been dried subsequent to pulping, was prepared. The slurry was homogenized at 8000 psig. at 20° and at 90° C. for from 1 to 20 passes. The resulting slurries were then freeze-dried and their cuene I.V.'s determined. The results are set forth in Table VII.

TABLE VII

| Sample No. | Temperature of Homogenization °C. | Number of Passes | Cuene I.V. dl/g |
|---|---|---|---|
| 1 | 20 | 0 | 8.83 |
| 2 | 20 | 1 | 8.81 |
| 3 | 20 | 5 | 8.46 |
| 4 | 20 | 10 | 8.15 |

TABLE VII-continued

| Sample No. | Temperature of Homogenization °C. | Number of Passes | Cuene I.V. dl/g |
|---|---|---|---|
| 5 | 20 | 20 | 7.55 |
| 6 | 90 | 0 | 8.66 |
| 7 | 90 | 1 | 8.65 |
| 8 | 90 | 5 | 8.30 |
| 9 | 90 | 10 | 7.86 |
| 10 | 90 | 20 | 7.10 |

Table VII illustrates that, as measured by the cuene I.V., the cellulose is substantially chemically unchanged as a result of the homogenization treatment.

The microfibrillated cellulose of the invention can be further characterized by acid hydrolysis rates of the resultant material as compared to hydrolysis rates for PFI milled or highly beaten material. The following examples relate to the relative rates of acid hydrolysis of microfibrillated cellulose as compared to pulp beaten in PFI mills.

EXAMPLE 11

Prehydrolyzed kraft pulp was beaten in a standard PFI mill using water as the beating medium. The beating proceeded to 10,000 revolutions at which point the CS Freeness was measured as 50 ml. In the realm of the paper industry this beating goes far beyond what is required for the formation of paper and begins to approach the limiting conditions for the PFI machine.

Prehydrolyzed kraft pulp was passed through a Manton-Gaulin homogenizer using water as a carrier, a pressure drop of 8000 psig and was homogenized at 100° C. for 9 passes. Acid hydrolysis of these samples was carried out at 60° C. in 1 M HCl for 1,2,3, and 5 hours. At the end of this time, the hydrolysis was stopped and the resultant material was exchanged in acetone and dried under vacuum at room temperature, over-night. Cuene IV measurements allow for the calculation of the rate of degradation increase. Degradation increase is directly related to the number of bonds broken during hydrolysis. The rate of bond breakage is a measure of cellulose open structure or accessibility. The rate of degradation increase for the microfibrillated cellulose of this example as compared with that of the highly beaten pulp is shown by the two solid lines in FIG. 2. As there shown it is about 3½ times as great for the microfibrillated cellulose.

EXAMPLE 12

Prehydrolyzed kraft pulp was beaten in a PFI mill using glycerine as the beating medium. Beating was carried out for 5000 revolutions to a measured CS Freeness of 137 ml. Prehydrolyzed kraft pulp was homogenized as described in Example 11 but using glycerine as the medium, and the comparative hydrolysis rates were determined in aqueous acid. The rate of degradation increase as produced by acid hydrolysis was again found to be significantly greater, 3.2× as great for the homogenized pulp as for the beaten pulp both produced in a glycerine medium. The rate of degradation increase for the two pulps is shown in the two dashed lines in FIG. 2.

EXAMPLE 13

Prehydrolyzed kraft pulp was beaten in a PFI mill using propylene glycol as the beating medium. The beating was carried out to 10,000 revolutions and a measured CSF of 129 ml. Prehydrolyzed kraft pulp was also homogenized in propylene glycol under 8000 psig. pressure drop. The relative rates of hydrolysis are shown in the two broken lines in FIG. 2. Again, the rate of degradation increase by hydrolysis for the homogenized pulp was 2.1 times as great as that of the highly beaten pulp.

In all cases therefore, pulps treated by homogenization were quantitatively more open or accessible than the most thoroughly beaten pulp produced in a PFI mill.

The chemical and physical accessibility of cellulose may also be measured by reaction with cellulase, an enzyme that hydrolyzes cellulose to release glucose. Accordingly, tests were carried out to compare the accessibility of microfibrillated cellulose to the action of cellulase enzyme with that of a number of other finely divided celluloses. The tests were carried out with *Trichoderma viride* enzyme, a cellulase complex that is able to convert crystalline, amorphous and chemically derived celluloses quantitatively to glucose (or substituted glucose from derivatives). The system is multienzymatic and contains at least three enzyme components, all of which play essential roles in the overall process.

EXAMPLE 14

A 1% slurry of sulfite pulp, which had not been dried subsequent to pulping was prepared from 50 grams of pulp suspended in 5 liters of deionized water. The slurry was homogenized at 8000 psig at 20° C. for 0,5 and 10 passes. The pulp suspensions were freeze-dried.

Samples of the freeze-dried microfibrillated cellulose were then tested for cellulase reactivity. In addition, for comparative purposes, Avicel microcrystalline cellulose, Solka-Floc ball-milled cellulose, PFI milled cellulose and a control sample of sulfite pulp, prior to homogenization, were also tested for cellulase reactivity. Solka-Floc is a trademark for a finely divided cellulose powder made by ball milling dried pulp. The PFI milled cellulose was milled for 12,500 revolutions to a CSF of 100 which was identical to the CSF of the 10 pass microfibrillated cellulose.

Samples (0.5000 g O.D.) were placed in flasks and 50 ml of acetate buffer was added. Then 0.0800 g of cellulase enzyme was added. The flasks were placed in a constant temperature shaker bath at 37°±1° C. After 70 and 170 hours, the samples were filtered on sintered glass and the filtrate was analyzed for free sugars by paper chromatography. Only glucose was detected. The results of cuene I.V. and cellulase tests are set forth in Table VIII.

TABLE VIII

| Cellulose Sample | Number of Passes | Cuene I.V. (dl/g) | Glucose Released by Cellulase Enzyme (mg/50 ml) 70 hrs. | 170 hrs. |
|---|---|---|---|---|
| Control Pulp | 0 | 8.83 | 37.5 | 41.0 |
| Microfibrillated | 5 | 8.46 | 77.0 | 107 |
| Microfibrillated | 10 | 8.15 | 92.5 | 157 |
| Microcrystalline | — | 1.16 | 15 | 18.5 |
| Ball-Milled | — | 4.08 | 36 | 47 |
| PFI Milled | — | 8.44 | 66 | 91 |

In spite of the small particle size and lower I.V. of the microcrystalline and ball-milled samples, they both were less reactive than either of the microfibrillated samples, and released less than ⅓ the glucose generated by 10 pass microfibrillated cellulose. The fibers of the PFI milled sample were similarly not opened as much as the microfibrillated cellulose even though they both had identical CSF values and only about 60% of the glucose generated by 10 pass microfibrillated pulp was released.

EXAMPLE 15

The microfibrillated cellulose of the invention can be used to impart significant strength increases to paper sheet structures. Thus, microfibrillated cellulose was prepared from a 2% aqueous slurry of prehydrolyzed kraft pulp which had been cut to 0.125 inch screen size and which had been passed through a homogenizer 5 times at a pressure of 8000 psi. 20,40 and 60% of the microfibrillated cellulose as a suspension, said percentages being based on the total sheet weight, was added to unbeaten prehydrolyzed kraft pulp and dispersed for 15 seconds in a blender. The slurry was then formed into hand sheets according to TAPPI method 7504 for making 1.25 gram hand sheets. The resulting hand sheets had the following properties:

TABLE IX

| Sample No. | Percent added Microfibrillated Cellulose | Weight of Sheet (g) | Dry Mullen Burst (kPa) |
|---|---|---|---|
| 1 (control) | 0 | 1.21 | 56 |
| 2 | 20 | 1.14 | 99 |
| 3 | 40 | 1.02 | 104 |
| 4 | 60 | 0.82 | 64 |

EXAMPLE 16

Another set of sheets was prepared using ½" cut rayon to make a non-woven sheet. The addition of 20,40 and 60% aqueous microfibrillated cellulose produced as in Example 15 gave the following results.

| Sample No. | Percent Added Microfibrillated Cellulose | Weight of Sheet (g) | ELB* | Dry Mullen Burst (kPa) |
|---|---|---|---|---|
| 1 (control) | 0 | Insufficient adherence to hold together | | |
| 2 | 20 | 0.64 | 53 | 129 |
| 3 | 40 | 0.70 | 60 | 180 |
| 4 | 60 | 0.68 | 57 | 116 |

*Elrepho Brightness against a black background to show sheet formation.

These results establish that microfibrillated cellulose is valuable as a binder for paper and for non-woven construction. Although it may be used in widely varying amounts, it will normally be added in amounts ranging from 0.5 to 40% of microfibrillated cellulose solids based on the weight of the paper product or non-woven sheet.

The foregoing is a description of illustrative embodiments of the invention, and it is applicants' intention in the appended claims to cover all forms which fall within the scope of the invention.

We claim:

1. A process for preparing microfibrillated cellulose comprising passing a liquid suspension of fibrous cellulose through a high pressure homogenizer having a small diameter orifice in which the suspension is subjected to a pressure drop of at least 3000 psi and a high velocity shearing action followed by a high velocity decelerating impact against a solid surface, repeating the passage of said suspension through the orifice until said cellulose suspension becomes a substantially stable suspension, said process converting said cellulose into microfibrillated cellulose without substantial chemical change of the cellulose starting material.

2. The process of claim 1 in which the liquid suspension is heated to at least 50° C. prior to passage through the orifice.

3. The process of claim 3 in which the liquid suspension is heated to at least 80° C.

4. The process of claim 1 in which the suspension is subjected to a pressure drop of at least 5000 psi.

5. The process of claim 1 in which the suspension contains no more than 10% by weight of cellulose.

6. The process of claim 5 in which the suspension contains 4 to 7% by weight of cellulose.

7. The process of claim 1 in which the suspension is an aqueous suspension.

8. The process of claim 1 in which the suspension is an organic suspension.

9. The process of claim 1 in which the shearing action is a right angle shearing action.

10. The process of claim 1 in which the suspension is subjected to the pressure drop at an elevated temperature.

11. The process of claim 10 in which the elevated temperature is at least 50° C.

* * * * *